US006817205B1

(12) United States Patent
Lifson et al.

(10) Patent No.: US 6,817,205 B1
(45) Date of Patent: Nov. 16, 2004

(54) DUAL REVERSING VALVES FOR ECONOMIZED HEAT PUMP

(75) Inventors: Alexander Lifson, Manlius, NY (US); Thomas J. Dobmeier, Phoenix, NY (US); Michael F. Taras, Fayetteville, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/693,556

(22) Filed: Oct. 24, 2003

(51) Int. Cl.[7] ..... F25B 13/00
(52) U.S. Cl. ..... 62/324.1; 62/117
(58) Field of Search ..... 62/117, 324.1, 62/324.2, 324.6, 325

(56) References Cited

U.S. PATENT DOCUMENTS

| | | | | | |
|---|---|---|---|---|---|
| 4,377,074 | A | * | 3/1983 | Jardine | 62/183 |
| 4,876,859 | A | | 10/1989 | Kitamoto | |
| 5,095,712 | A | * | 3/1992 | Narreau | 62/113 |
| 5,161,387 | A | * | 11/1992 | Metcalfe et al. | 62/126 |
| 5,626,027 | A | * | 5/1997 | Dormer et al. | 62/175 |
| 5,875,637 | A | | 3/1999 | Paetow | |
| 6,047,556 | A | | 4/2000 | Lifson | |
| 6,206,652 | B1 | | 3/2001 | Caillat | |
| 6,276,148 | B1 | * | 8/2001 | Shaw | 62/117 |

OTHER PUBLICATIONS

Systems & Advanced Technologies Engineering S.r.I., publication entitled "Compsys—Dynamic Simulation of Gas Compression Plants", dated Jun. 12, 2002.
Copeland Europe publication entitled "Refrigeration Scroll for Parallel Applications" dated Feb. 26, 2002.

* cited by examiner

*Primary Examiner*—Melvin Jones
(74) *Attorney, Agent, or Firm*—Carlson, Gaskey & Olds

(57) ABSTRACT

A refrigerant system is operable either in a heating mode or a cooling mode. The system is also provided with an economizer cycle that will function in both heating mode or cooling mode. A pair of four-way valves control the flow of refrigerant through the refrigerant cycle in a preferred embodiment. The first valve properly routes the refrigerant from the compressor either to the outdoor heat exchanger or to the indoor heat exchanger dependent upon whether cooling mode or heating mode is in place. The second valve routes the refrigerant serially from either the outdoor heat exchanger or the indoor heat exchanger through an economizer heat exchanger and a main expansion device, again dependent on whether the refrigerant cycle is in a cooling mode or in a heating mode. A tap is positioned upstream of the economizer heat exchanger and taps a portion of the refrigerant to provide the economizer function. The present invention thus provides a simple system for utilizing a refrigerant cycle for both cooling and heating modes, while still providing an economizer function in both modes.

8 Claims, 3 Drawing Sheets

DUAL REVERSING VALVES FOR ECONOMIZED HEAT PUMP

BACKGROUND OF THE INVENTION

This invention relates to a refrigerant system that may be utilized for operation in both a heating and cooling modes, and wherein an economizer cycle is provided in both modes with a pair of reversing valves to properly route the refrigerant.

Refrigerant systems provide cooled air in an air conditioning mode and a heated air in a heat pump mode. In a standard heat pump without an economized cycle, there is a single four-way reversing valve installed next to a compressor discharge port. Essentially, the refrigerant flow through the system is reversed to provide the two distinct modes. When in a cooling mode, the valve adjacent to the compressor routes the refrigerant from the compressor discharge port into an outdoor heat exchanger and from an indoor heat exchanger into compressor suction port. In a heating mode, this valve routes this refrigerant from the compressor discharge into the indoor heat exchanger and from the outdoor heat exchanger into compressor suction port.

One modern development in refrigerant cycles is the inclusion of an economizer cycle. An economizer cycle taps a portion of a refrigerant flow downstream of the outdoor heat exchanger in cooling mode or downstream of the indoor heat exchanger in heating mode. The tapped refrigerant is used to subcool the main refrigerant flow. The tapped refrigerant passes through an expansion device, where its temperature is reduced during the expansion process, and then through an economizer heat exchanger. In the economizer heat exchanger, the tapped refrigerant exchanges heat with the main refrigerant flow. The tapped refrigerant is then returned to an economizer port of the compressor after having cooled the main refrigerant flow.

While economizer cycles are known in dedicated air conditioning cooling systems, and have been proposed for operation in heating mode of heat pump systems, there have been no effective solution for heat pump systems that successfully incorporate an economizer cycle that can be used in the same system during either cooling or heating mode of operation.

SUMMARY OF THE INVENTION

A pair of valves control the flow of refrigerant through the refrigerant cycle, and through the components in an economizer cycle. Preferably, four-way reversing valves are used, although other valves come within the scope of this invention.

The first valve controls the flow from and to the compressor, routing the refrigerant initially from the compressor discharge port, either to the outdoor heat exchanger (cooling mode) or to the indoor heat exchanger (heating mode). This valve also controls the return of refrigerant back to the compressor, routing the refrigerant into compressor suction port from the indoor heat exchanger (cooling mode) or from the outdoor heat exchanger (heating mode). In this invention, a second four-way reversing valve is added to the system. This second valve selectively controls the flow of the refrigerant at a point intermediate of these two heat exchangers, such that the refrigerant flows serially to an economizer heat exchanger and a main expansion device. Further, an economizer tap is provided with an economizer expansion device where this second valve also controls the flow of a tapped refrigerant through the economizer heat exchanger and into a compressor economizer port. The second four-way reversing valve is thus positioned to control and route the refrigerant flow in the appropriate direction to provide the economizer cycle when the system is operating either in cooling or heating mode.

These and other features of the present invention can be best understood from the following specification and drawings, the following of which is a brief description.

DETAILED DESCRIPTION OF THE PREFERRED EMBODIMENT

Figure 1:
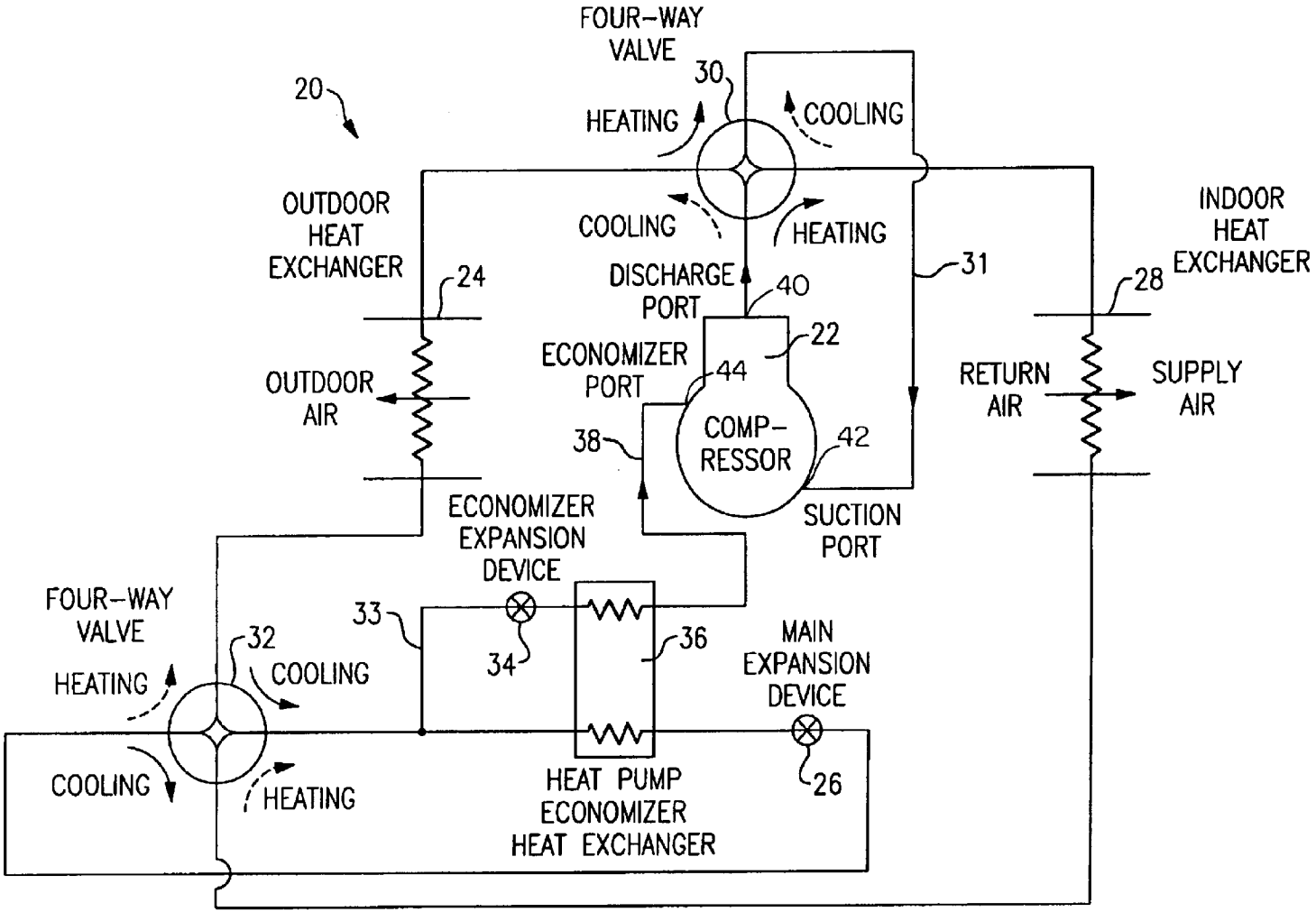
FIG. 1 is a schematic view showing an overall refrigerant cycle.

FIG. 1 shows a refrigerant cycle 20, having a compressor 22. Compressor 22 is preferably a scroll compressor, however, this invention extends to other compressor types.

An outdoor heat exchanger 24 exchanges heat between refrigerant flow and outdoor air. The main expansion device 26 is positioned between the outdoor heat exchanger 24, and an indoor heat exchanger 28 that exchanges heat with an indoor air. A four-way reversing valve 30 controls the flow of refrigerant from the compressor discharge port 40 either to the outdoor heat exchanger 24 (cooling mode) or to the indoor heat exchanger 28 (heating mode). In this invention, another four-way reversing valve 32 is added that can be shifted between cooling and heating mode positions to control the flow of the refrigerant downstream from either the outdoor heat exchanger 24, or from the indoor heat exchanger 28.

A hard shutoff expansion device 34 allows the flow of a refrigerant from a tap 33 to an economizer heat exchanger 36. A return line 38 returns the tapped flow back to the compressor 22 through intermediate port 44. A line 31 returns the refrigerant from the indoor heat exchanger 28 (cooling mode) or outdoor heat exchanger 24 (heating mode) to the compressor 22, dependent upon the position of the four-way valve 30.

Figure 2:
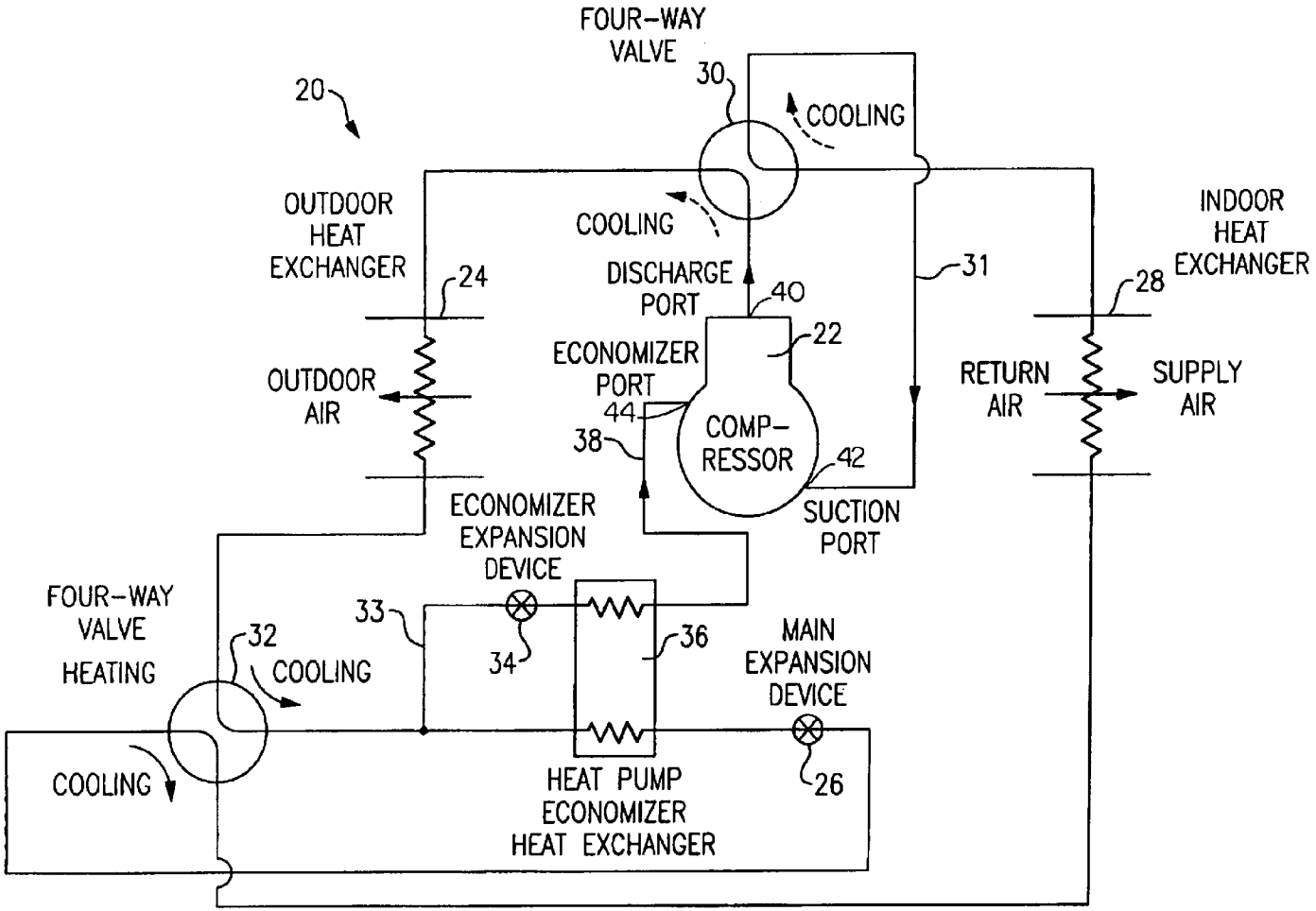
FIG. 2 shows the refrigerant cycle configured for cooling mode.

As shown in FIG. 2, the valves 30 and 32 are in the cooling mode position. Refrigerant passes serially from the compressor 22 to the outdoor heat exchanger 24, through the main expansion device 26, to the indoor heat exchanger 28, then returning to the compressor 22 through the line 31. The refrigerant system may operate in a non-economizer mode. In such mode, valve 34 is preferably closed, and refrigerant does not flow through line 38.

Generally, the economizer cycle is operative when enhanced performance (capacity and efficiency) is desired. When the economizer cycle is desired for cooling mode, then the valves 30 and 32 are in the position as shown in the FIG. 2. Valve 34 is opened to provide an expansion function on refrigerant tapped through the line 33. Refrigerant flowing through the expansion device 34 is expanded and thus cooled. This cooler refrigerant subcools the main refrigerant flow also passing through the economizer heat exchanger 36. This main refrigerant flow then expanded through the main expansion device 26. The tapped refrigerant from the line 33, after having passed through the economizer heat exchanger 36, is returned through line 38 to an intermediate compressor port 44.

Figure 3:
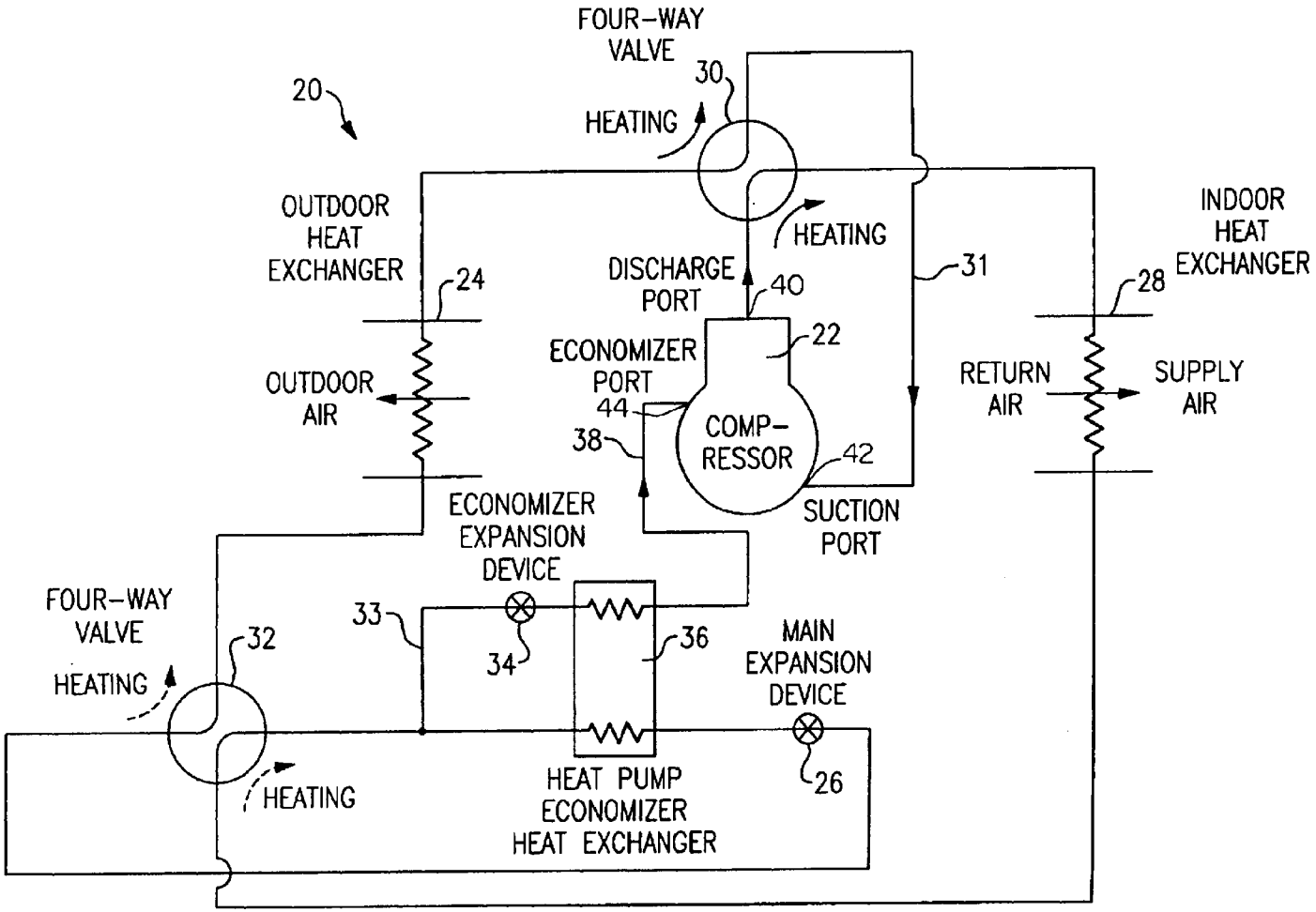
FIG. 3 shows the refrigerant cycle configured for heating mode.

FIG. 3 shows the refrigerant cycle 50, however now in a heating mode. Note, the operating position of both valves 30 and 32 has changed. The refrigerant from the compressor 22 passes to the indoor heat exchanger 28, to the main expansion device 26, and then the outdoor heat exchanger 24. From the outdoor heat exchanger 24, the refrigerant passes through the valve 30, then returning the refrigerant into the line 31, and back to the compressor 22. Again, the system may operate in heating mode without any economizer cycle. Under such conditions, valve 34 is maintained tightly closed. However, should an economizer cycle be desirable, then the expansion device 34 is opened to provide an expansion function. The refrigerant from the line 33 is now expanded by the expansion device 34, and subcools the main refrigerant flow in the economizer heat exchanger 36. The refrigerant is again returned through the line 38 back to the compressor 22.

A control for the system, operates the expansion device and valve 34, and the valves 30 and 32, dependent on whether heating or cooling modes, and whether economizer cycle is desired. Also, while the economizer expansion device and valve are shown as a single component, separate components may be used. A worker of ordinary skill in the art would recognize how to provide an appropriate control.

Additionally, although parallel arrangement for economizer heat exchanger is shown on the drawings, counterflow configuration can be utilized as well.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant cycle comprising:

a compressor;

an outdoor heat exchanger;

a main expansion device;

an indoor heat exchanger, and a flow control for selectively routing refrigerant from said compressor downstream to said outdoor heat exchanger in a cooling mode, and downstream to said indoor heat exchanger in a heating mode;

a valve for selectively communicating refrigerant from a refrigerant path into an economizer heat exchanger at a point intermediate of said outdoor heat exchanger and said indoor heat exchanger, with a main flow of refrigerant further passing through said economizer heat exchanger such that an economizer cycle can be provided when said refrigerant cycle is in either said cooling or said heating mode, said economizer cycle being provided with a tap for refrigerant, said tap taking refrigerant from a location intermediate said outdoor heat exchanger and said economizer heat exchanger when in cooling mode, and from a location intermediate said indoor heat exchanger and said economizer heat exchanger when in said heating mode.

2. A refrigerant cycle as set forth in claim 1, wherein said valve is provided for selectively routing refrigerant from either of said outdoor heat exchanger or said indoor heat exchanger serially through said economizer heat exchanger, and then through said main expansion device, with said tap being provided from a line between said second valve and said economizer heat exchanger.

3. A refrigerant cycle as set forth in claim 2, wherein said economizer expansion device is positioned on said tap, and upstream of said economizer heat exchanger.

4. A refrigerant cycle as set forth in claim 2, wherein a return line returns said tapped refrigerant from said economizer heat exchanger back to said compressor.

5. A refrigerant cycle as set forth in claim 1, wherein said valve is a four-way reversing valve.

6. A refrigerant cycle comprising:

a compressor;

an outdoor heat exchanger;

a main expansion device;

an indoor heat exchanger;

a first valve for selectively providing a refrigerant from said compressor to said outdoor heat exchanger in a cooling mode, or to said indoor heat exchanger in heating mode;

a second valve provided for selectively routing refrigerant from either of said outdoor heat exchanger or said indoor heat exchanger serially through an economizer heat exchanger, and then through said main expansion device, with a tap being provided from a line between said second valve and said economizer heat exchanger;

an economizer expansion device positioned on said tap, and upstream of said economizer heat exchanger; and a return line returning said tapped refrigerant from said economizer heat exchanger back to said compressor.

7. A method as set forth in claim 6, wherein a second four-way valve is selected positioned to route a refrigerant from said outdoor heat exchanger serially through said economizer heat exchanger and then through said main expansion device in a cooling mode, and to serially route said refrigerant from said indoor heat exchanger through said economizer heat exchanger and then said main expansion device in a heating mode.

8. A method of operating a refrigerant cycle comprising the steps of:

(1) providing a refrigerant cycle including a compressor, an outdoor heat exchanger, a main expansion device and an indoor heat exchanger, and providing a first four-way valve for separately communicating a refrigerant from said compressor either to said outdoor heat exchanger in cooling mode, or to said indoor heat exchanger in heating mode, and providing a shutoff valve for controlling flow from a tapped portion of said refrigerant through an economizer heat exchanger to provide an economizer cycle;

(2) operating said refrigerant cycle in either said cooling or said heating mode;

(3) providing an economizer function if desired, by allowing flow of said tapped refrigerant through said economizer heat exchanger in both said cooling and heating modes, and wherein said tapped refrigerant is taken from a location intermediate said outdoor heat exchanger and said economizer heat exchanger in said cooling mode, and from a location intermediate said indoor heat exchanger and said economizer heat exchanger in said heating mode.

* * * * *

UNITED STATES PATENT AND TRADEMARK OFFICE

CERTIFICATE OF CORRECTION

PATENT NO. : 6,817,205 B1
DATED : November 16, 2004
INVENTOR(S) : Lifson et al.

It is certified that error appears in the above-identified patent and that said Letters Patent is hereby corrected as shown below:

Column 4,
Line 32, "selected" should read as -- selectively --.

Signed and Sealed this

Fifteenth Day of February, 2005

JON W. DUDAS
*Director of the United States Patent and Trademark Office*